United States Patent [19]

LaRosa et al.

[11] Patent Number: 4,767,058

[45] Date of Patent: Aug. 30, 1988

[54] SPRAY HEAD COMPRISING CAP MEMBER WITH ROTATABLE/DEPRESSIBLE VALVE HELD BY FRANGIBLE LOCKING COLLAR

[75] Inventors: Joseph P. LaRosa, Danbury; Michael H. Lombardi, Stamford, both of Conn.

[73] Assignee: Chesebrough-Pond's Inc., Greenwich, Conn.

[21] Appl. No.: 880,366

[22] Filed: Jun. 30, 1986

[51] Int. Cl.[4] ..... B05B 7/30; B67B 5/00; B67D 5/32

[52] U.S. Cl. ..... 239/309; 239/318; 222/81; 222/153

[58] Field of Search ..... 239/309, 310, 315, 316, 239/318, 328, 373, 375, 10; 222/153, 81, 82, 83, 83.5, 88, 470, 475, 325, 89

[56] References Cited

U.S. PATENT DOCUMENTS

| | | | |
|---|---|---|---|
| Re. 29,405 | 9/1977 | Gunzel, Jr. | 239/318 |
| 1,099,767 | 6/1914 | Read | 239/309 X |
| 1,968,316 | 7/1934 | Schmitt | 222/153 |
| 2,887,272 | 5/1959 | Rosenthal | 239/309 X |
| 3,186,643 | 6/1965 | George et al. | 239/318 |
| 3,447,753 | 6/1969 | Proctor et al. . | |
| 3,554,450 | 1/1971 | D'Muhala | 239/309 |
| 3,739,941 | 6/1973 | Ostrowsky etal. | 222/153 |
| 3,763,888 | 10/1973 | Duecker | 239/318 X |
| 3,770,205 | 11/1973 | Proctor | 239/318 X |
| 3,797,704 | 4/1974 | Dykes | 222/153 X |
| 3,940,069 | 2/1976 | Gunzel, Jr. | 239/318 |
| 3,964,641 | 6/1976 | Langensiepen et al. | 222/153 X |
| 3,964,689 | 6/1976 | Horvath, Jr. | 239/318 |
| 4,377,106 | 3/1983 | Workman et al. | 222/153 X |
| 4,384,660 | 5/1983 | Palmisano et al. | 222/153 |
| 4,408,700 | 10/1983 | Fillmore et al. | 222/153 |

FOREIGN PATENT DOCUMENTS

| | | | |
|---|---|---|---|
| 509182 | 7/1939 | United Kingdom | 239/318 |

*Primary Examiner*—Andres Kashnikow
*Assistant Examiner*—Mary Beth O. Jones
*Attorney, Agent, or Firm*—Melvin H. Kurtz

[57] ABSTRACT

A spray head is disclosed having an aligned fluid conduit leading respectively to a source of pressurized water and a spray outlet. A rotatable, vertically movable valve element lies in a suitable bore in the spray head between the conduits. The valve has a horizontal conduit therethrough which merges with a vertical conduit adapted to convey liquid from a container to which the spray head is connected. A frangible locking collar lies between the head of the valve and the upper surface of the spray head holding the valve from either rotational or vertical movement towards the container. Breaking and removal of the locking collar allows for 90° rotation of the valve to unseat inwardly from a flange carried by the valve body from inwardly projecting retaining flanges carried by the spray head body thereby allowing for downward movement of the valve to puncture a seal over the container holding the liquid. This downward movement also brings the conduit in the valve into the same plane as the two conduits in the spray head. Rotation of the valve 90° back to its original orientation aligns and interconnects all the conduits making the system ready for use upon activation of the source of pressurized water.

5 Claims, 5 Drawing Sheets

SPRAY HEAD COMPRISING CAP MEMBER WITH ROTATABLE/DEPRESSIBLE VALVE HELD BY FRANGIBLE LOCKING COLLAR

BACKGROUND OF THE INVENTION

1. Field of the Invention

The present invention relates to a spray apparatus which can be used, for example, to apply agricultural chemicals to lawns, shrubs, and the like.

2. Description of the Prior Art

One way in which liquids, such as agricultural chemicals, can be applied to lawns, shrubs, and the like is by the provision of a suitable container containing the chemical in liquid form which is adapted to be attached to a source of pressurized water, e.g., a garden hose, for application of the liquid chemical in the form of a more dilute aqueous spray composition. Passage of the pressurized water through the spray head attached to the container holding the liquid chemical results in an appropriate metering of the liquid chemical from the container, through suitable conduit means, to be mixed with the pressurized water in the spray head and then applied to the desired location. The present invention is particularly directed to this type of application and a spray apparatus to be used therewith.

When liquid chemical solutions are to be used by the consumer, it is highly desirable that the delivery system be designed to be both easy to operate and yet safe from unauthorized tampering and possible use by children. The present invention is directed to satisfying this need in such a delivery system.

SUMMARY OF THE PRESENT INVENTION

The present invention relates to a spray head for mixing pressurized water with a liquid chemical and providing a spray thereof. The spray head comprises a cap member having internal fluid conduit means which respectively communicate with a source of the pressurized water and with an outlet for the spray produced by the spray head. The cap member has a rotatable valve located in a suitable bore inside the cap between the fluid conduit means in the cap member which, upon suitable rotation and positioning, is adapted to allow for intercommunication of the aforementioned fluid conduit means in the cap member by means of an aligned fluid conduit in the valve which also communicates with a fluid conduit for liquid in the container to produce the desired spray upon mixing of the pressurized water with the liquid which is drawn up from the container. The valve means is also movable towards the portion of the cap member which is adapted to be attached to the container holding the liquid to allow for piercing of a seal covering the neck of the container when the valve means is in a more proximate location to the container and to place the conduit means in valve in proper alignment with the conduit means in the cap member when the valve is suitably rotated. The piercing of the seal allows liquid to be drawn into the valve from the container through the container neck to ultimately mix with the pressurized water and produce the desired spray mixture of water and liquid chemical when all the fluid conduit means are interconnected upon suitable rotation of the valve. The spray head also includes a frangible locking collar (to help prevent undesired tampering) which must first be removed to allow for both rotation of the valve means as well as its movement towards the container to pierce the seal.

The spray head of the present invention, as will be described below, has certain features (e.g., the locking collar and valve means) which, from a safety viewpoint, make it difficult for a child to inadvertently utilize the system since a particular sequence of actions needs to be taken to activate it.

DESCRIPTION OF THE DRAWINGS

The present invention will be more fully understood by reference to the Drawings which form a portion of the present specification wherein.

DETAILED DESCRIPTION OF THE PRESENT INVENTION

Figure 1:
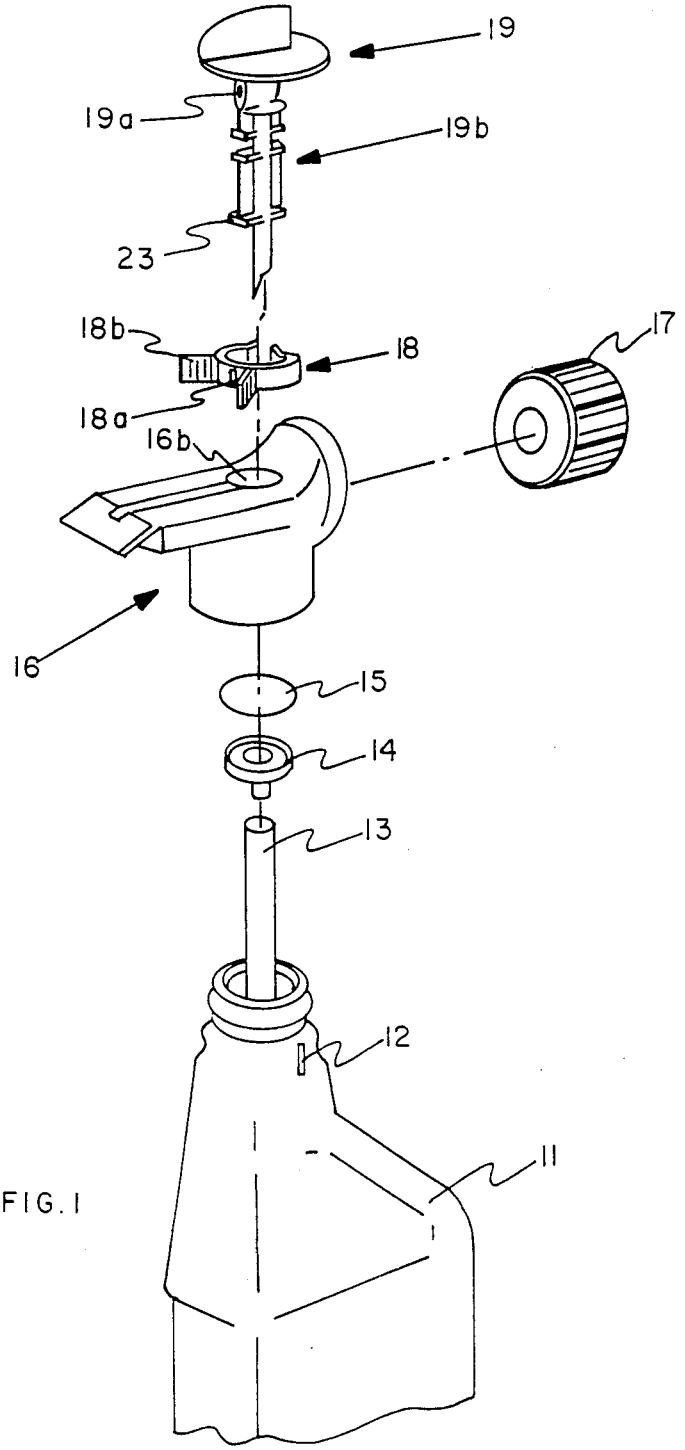
FIG. 1 is an exploded view showing the various components of the spray apparatus of the delivery system described herein including the spray head of the present invention.

The general operation of the spray apparatus of the present invention can be generally understood by referring to FIG. 1. A container 11, having an optional alignment keyway 12 on its neck to allow for proper alignment of the spray head to be described below, is designed to hold the liquid (e.g., an agricultural chemical) to be dispersed as as aqueous spray in accordance with the present invention. A dip tube 13 which extends into the container below the liquid level therein is held in the container neck by a dip tube retaining disk 14 over which is placed a seal 15 to prevent inadvertent dispensing of the liquid from the container 11. The spray head of the present invention fits over the seal as a closure for the entire assembly.

Figure 6:
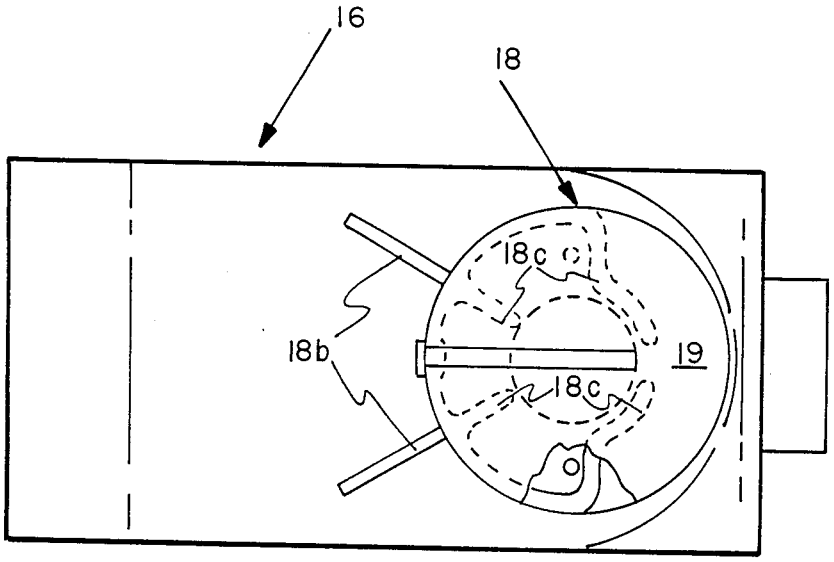
FIG. 6 is an overhead view, partially broken away, illustrating the position of the locking collar and valve on the upper surface of the spray head.

In order to dispense the liquid from the container 11 using a source of pressurized water (e.g., from a garden hose), the present invention contemplates the use of a novel spray head apparatus. This spray head apparatus comprises a spray head body or cap member 16 containing appropriate fluid conduit means leading to the source of pressurized water and to the spray head outlet which can be interconnected by means of a valve, a hose adapter 17 which can join the cap member 16 to the source of pressurized water, a frangible locking collar 18, and a rotatable and vertically movable valve 19 held from movement within a central vertical bore 16*b* in spray head 16 by the collar. This valve 19 also contains fluid conduit means which respectively are adapted to interconnect the conduit means in the spray head and also lead to the liquid in the container. The locking collar 18, which is preferably formed of plastic, has a slot 18*a* into which a suitable implement (e.g., a screwdriver or knife blade) can be placed to break it into two pieces whereby freeing the valve 19. The locking collar also has outwardly protruding flanges 18*b* on opposed sides of the slot 18*a* which can be squeezed towards one another to flex the material forming the collar immediately above and below slot 18*a* to cause it to fracture. This removes inwardly protruding retaining fingers 18*c* of the collar 18 from retaining contact with the valve as shown in FIG. 6. The valve 19 has a fluid conduit 19*a* and an outwardly protruding retaining flange element 19*b* which cooperates with step means inside the cap member 16, as will be described hereinafter, to hold the valve 19 in either an upwardly position or a downwardly position more proximate to the container 11 when it is in one position but which can be disengaged upon suitable rotation of the valve to allow for its upward or downward movement in relationship to the cap member 16.

The invention's general mode of use is rather straightforward. After the cap member 16 has been attached to the container 11 and a source of pressurized water through hose adapter 17, the first step in regard to its use involves the breaking and removal of the frangible locking collar 18 to free the valve 19 for both rotational movement as well as movement towards the container 11 after being properly rotated. The next step in use of the present invention involves rotation of valve 19 approximately 90° to also move the retaining flange 23 element from its original location thereby allowing it to clear the step means holding it from vertical movement within the bore in cap member 16 within which the valve 19 is seated. The valve 19 is then pushed downwardly so that its bottom portion (which preferably comes to a point) pierces seal 15. The next step involves the 90° rotation of the valve 19 back to its original rotational position to align fluid conduit means 19*a* in the valve 19 with the axis running through hose adapter 17 and through the cap member 16 along which the fluid conduit means in cap member 16 are oriented. This action intercommunicates the various fluid conduit means in the cap member 16 and valve 19, as will be shown in more detail hereinafter, allowing the initial admixture of pressurized water with the liquid in container 11 within the valve 19 in cap member 16 when the pressurized water is fed through the conduit 19*a* in valve 19 from the hose connected to hose adapter 17.

Figure 2:
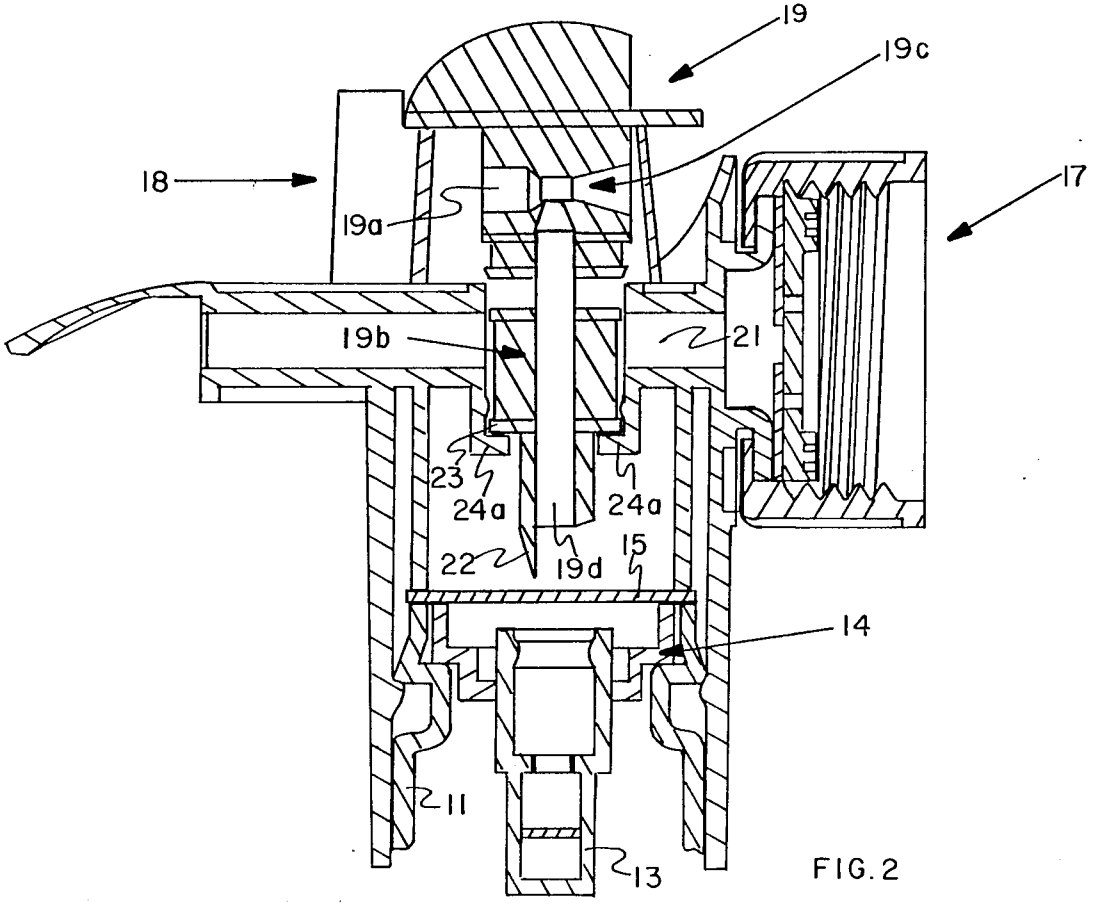
FIG. 2 is a cross-sectional view of the upper portion of the container and the spray head showing the rotatable valve means in its upward position with the frangible locking collar in place before the valve is rotated and moved downwardly to pierce the seal over the container neck.

FIG. 2 illustrates the cap member 16 in greater detail when generally cylindrical valve 19 is in its original upward position before locking collar 18 has been removed and before the seal 15 covering the dip tube retaining disk 14 has been pierced. As can be seen from this view, the conduit 19*a* in the valve 19, which is adapted to ultimately align with aligned fluid conduit means 20 (water and admixed liquid conduit leading to the spray outlet) and 21 (water conduit leading from the hose adapter) in cap member 16, is vertically displaced from its necessary position when the spray apparatus is actually operational. Conduit 19*a* has a narrowed venturi section 19*c* immediately before (i.e., in the direction towards the hose adapter 17) its merger point with a downwardly extending conduit 19*d* which ultimately provides the conduit for the liquid from the container 11. The venturi arrangement results in a pressure drop in conduit 19*a* sufficient to draw liquid up from the container 11 through dip tube 13, dip tube retaining disk 14 and conduit 19*d* in valve 19. The liquid and water first mix at the juncture of conduits 19*a* and 19*d* in valve 19. The bottom portion of the valve 19 terminates in a sharpened point 22 adapted to pierce seal 15.

The outwardly protruding retaining flange element 19*b* attached to the body of valve 19 is held from vertical movement by the cooperation of its lowermost, more outwardly extending flange 23 (which, like element 19*b*, is not a continuous structure around the entire circumference or periphery of the valve 19) with inwardly projecting flanges 24*a* arranged in pairs on opposed sides of the cap member facing the valve. These projections also do not extend completely around the periphery of the internal bore of the cap member 16 holding the valve 19 so as to allow for disengagement of flanges 23 carried by portion 19*b* and flanges 24*a* upon appropriate (e.g., 90°) rotation of the valve 19.

Figure 3:
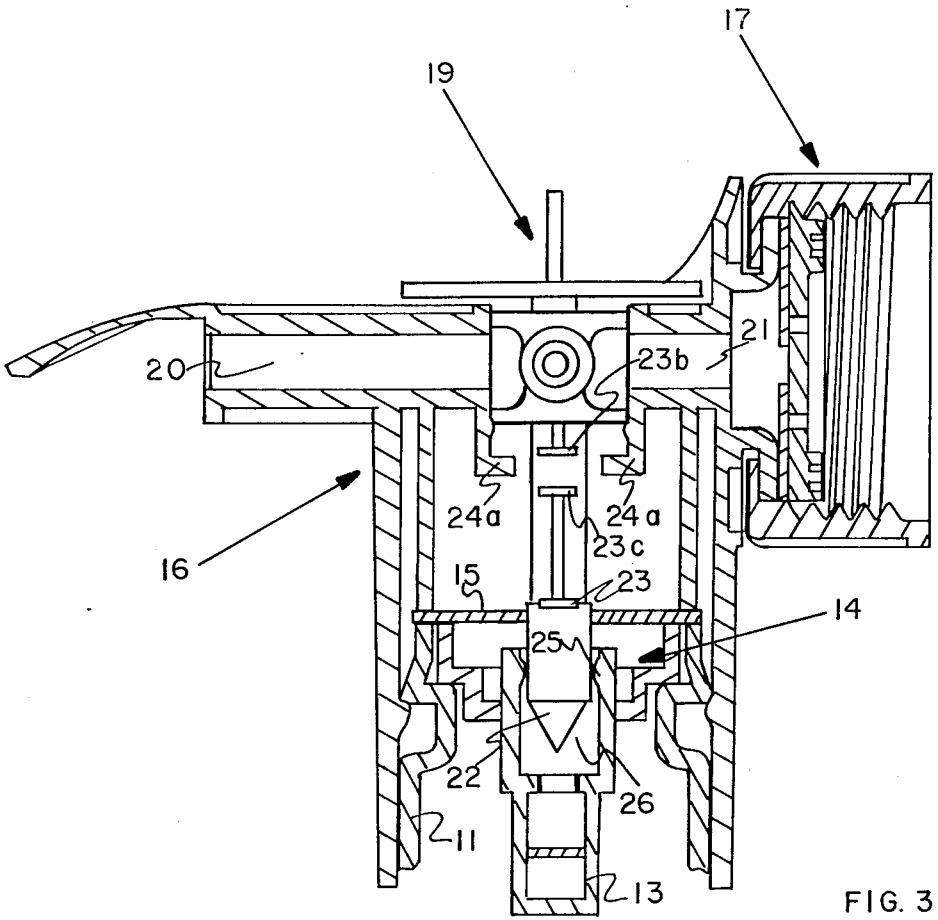
FIG. 3 is a cross-sectional view, similar in orientation to that of FIG. 2, showing the position of the valve after the frangible locking collar has been removed and the valve has been rotated 90° and moved downwardly to pierce the seal.

FIG. 3 illustrates the position of the valve 19 in the cap member 16 after the valve has been rotated 90° and moved downwardly so that sharpened point 22 breaks seal 15 allowing for mating of the bottom section of the valve with the inner surface of the dip tube retaining disk 14 to form an air tight seal allowing the venturi effect to ultimately draw liquid from container 11. Since the two outwardly extending flanges 23 of valve 19 only extend around about 35° of the periphery of the valve surface and the valve surface has a more narrow diametered "interruption" therebetween, the orientation shown in FIG. 3 presents a more narrow cross-section of the complementary dimensioned flanges 24*a*. In other words, the 90° rotation "unseats" the flange members 23 from between the flanges 24*a* thereby placing the valve body portion 19*b* in a position where no inwardly facing flanges 24*a* protrude into the bore holding the valve 19 so as to meet with the flange 23 carried by valve 19. This allows the downward movement of valve 19 until it makes sealing contact at 25 with the inner wall of the central bore 26 of the dip tube retaining disk 14. The act of moving the valve 19 downwardly not only results in puncture of the seal 15, it also displaces the position of bore 19*a* of valve downwardly so that it is in the proper position to be aligned with conduits 20 and 21 in cap member 16 upon suitable later rotation of valve 19 back to its original rotational position.

Figure 4:
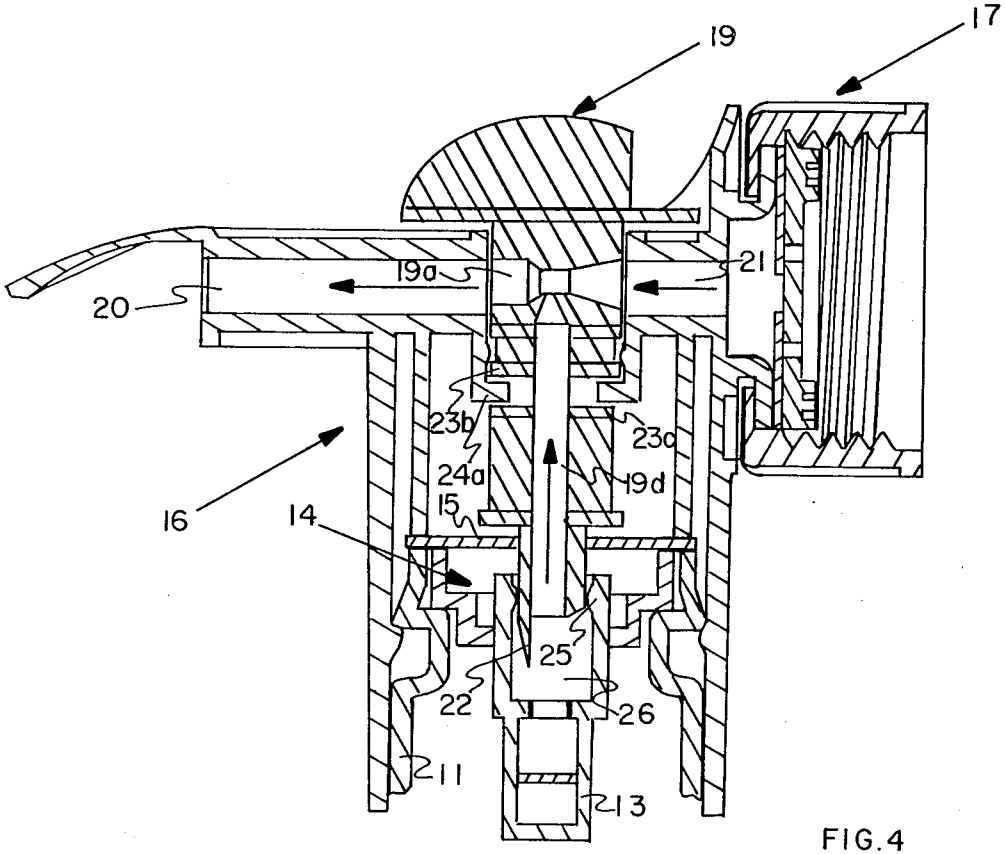
FIG. 4 is a view similar in orientation to the views of FIGS. 2 and 3 which illustrates the valve in its downward position after the valve has been moved into a location more proximate to the container neck to pierce the seal and then has been suitably rotated to allow for intercommunication of the various fluid conduit means in the spray head and valve.
Figure 5:
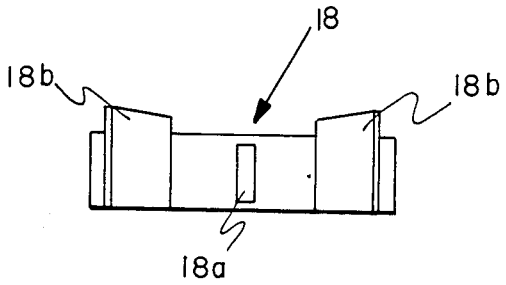
FIG. 5 is a frontal view of the frangible locking collar.

FIG. 4 shows the orientation of the valve 19 after it has been rotated 90° from the orientation shown in FIG. 3 to its original rotational position to appropriately align bore 19*a* in the valve 19 with fluid conduits 20 and 21 in the cap member 16 so that fluid can flow as indicated by the arrows when the source of pressurized water is activated. Such activation sends the water through hose adapter 17 into conduit 21 and ultimately through bore 19*a* where it mixes with liquid chemical from container 11 drawn into conduit 19*d* to yield a mixture of water and the liquid chemical in conduit 20 leading to the outlet of the spray head. The valve is held in this position by the cooperation of flanges 23*b* and 23*c* on valve 19 with flanges 24*a*.

In a preferred embodiment, the present invention contemplates a disposable system (preferably formed of suitable plastic elements) where all the elements shown in FIG. 1 would be sold as a prepackaged system to an intended user (e.g., a household consumer), used for a single application of the liquid in the container to a desired locus, and then suitably be disposed of. The system provides a simple and convenient way to apply liquid chemicals, for example, without the need to premix or store them for later use. The manufacturer of the instant system would insure the proper strength in the container and the spray head would be designed to mix the proper proportions of water and chemical.

The foregoing illustrates certain embodiments of the present invention but should not be construed in a limiting sense. The scope of protection that is sought is set forth in the claims which follows.

We claim:

1. A spray head for mixing pressurized water with a liquid held in a container with a seal to which the head is adapted to be attached and providing a spray thereof which comprises:

(a) a cap member having fluid conduit means therein which respectively are adapted to communicate with
(i) a source of the pressurized water; and
(ii) an outlet for the spray;

(b) a rotatable valve located in a bore between the fluid conduit means in the cap member which valve is adapted, upon rotation and movement towards the sealed container to unseal the container and also achieve intercommunication of the source of pressurized water and the outlet for the spray through the fluid conduit means in the cap member and an aligned fluid conduit means in the valve, which valve has additional conduit means connected to said aligned fluid conduit means, which also communicates with a fluid conduit for the liquid in the container to be contained in the spray, thereby allowing liquid to be aspirated into the valve from the container through a neck on the container to mix with the pressurized water and produce the spray when the fluid conduit means in the cap are intercommunicated with the aligned fluid conduit means in the valve; and (c) a frangible locking collar holding and preventing the valve from both rotation and movement towards the container except after the collar has been broken and removed from the valve.

2. A spray head as claimed in claim 1 wherein the locking collar lies on a surface of the cap member between the cap member and an upper portion of the rotatable valve.

3. A spray head as claimed in claim 1 wherein the valve has a sharpened point to allow for piercing of the seal over the container.

4. A spray head for mixing pressurized water with a liquid held in a sealed container to which the head is adapted to be attached and providing a spray thereof which comprises:

(a) a cap member having fluid conduit means therein which respectively are adapted to communicate with
(i) a source of the pressurized water; and
(ii) an outlet for the spray;

(b) a rotatable valve located in a bore between the fluid conduit means in the cap member which valve is adapted, upon rotation and movement towards said sealed container to unseal the container and also achieve intercommunication of the fluid conduit means in the cap member with an aligned fluid conduit means in the valve, which valve has additional conduit means, connected to said aligned fluid conduit means, which also communicates with a fluid conduit for the liquid in the container to be contained in the spray, thereby allowing liquid to be aspirated into the valve from the container through a neck on the container to mix with the pressurized water and produce the spray when the fluid conduit means in the cap are intercommunicated with the aligned fluid conduit means in the valve;

(c) a frangible locking collar holding and preventing the valve from both rotation and movement towards the container except after the collar has been broken and removed from the valve; and (d) a hose adapter adjacent the fluid conduit means in the cap member leading to the source of pressurized water.

5. A spray head for mixing pressurized water with a liquid held in a sealed container to which the head is adapted to be attached and providing a spray thereof which comprises:

(a) a cap member having fluid conduit means therein which respectively are adapted to communicate with
(i) a source of the pressurized water; and
(ii) an outlet for the spray;

(b) a rotatable valve located in a bore between the fluid conduit means in the cap member which valve is adapted, upon rotation and movement towards said sealed container to unseal the container and also achieve intercommunication of the fluid conduit means in the cap member with an aligned fluid conduit means in the valve, which valve has additional conduit means, connected to said aligned fluid conduit means, which also communicates with a fluid conduit for the liquid in the container to be contained in the spray, thereby allowing liquid to be aspirated into the valve from the container through a neck on the container to mix with the pressurized water and produce the spray when the fluid conduit means in the cap are intercommunicated with the aligned fluid conduit means in the valve; and (c) a frangible locking collar holding and preventing the valve from both rotation and movement towards the container except after the collar has been broken and removed from the valve, the spray head having inwardly projecting flange means located in a portion of the bore in the cap member holding the rotatable valve which is adapted to cooperate with flange means carried by the valve to hold it for movement towards the container.

* * * * *